4/26/83 XR 4,381,504

United States Patent [19]

Bitko

[11] 4,381,504

[45] Apr. 26, 1983

[54] SWITCH AND ALARM SYSTEM RESPONSIVE TO SUDDEN MOVEMENT, ANGULAR TILT AND VIBRATION

[75] Inventor: David Bitko, Brunswick, N.J.

[73] Assignee: Fifth Dimension Inc., Trenton, N.J.

[21] Appl. No.: 229,942

[22] Filed: Jan. 30, 1981

[51] Int. Cl.[3] ..... G08B 21/00

[52] U.S. Cl. ..... 340/689; 200/61.51; 340/566; 340/683

[58] Field of Search ..... 340/689, 683, 566, 65; 200/61.95 R, 61.51, 61.52

[56] References Cited

U.S. PATENT DOCUMENTS

| | | | |
|---|---|---|---|
| 3,359,550 | 12/1967 | Christensen | 200/61.51 |
| 3,725,890 | 4/1973 | Cirino | 340/689 |
| 3,761,653 | 9/1973 | Eranosian | 200/61.51 |
| 3,820,066 | 6/1974 | Kennell | 340/64 |
| 4,297,690 | 10/1981 | Baker | 340/689 |

*Primary Examiner*—Glen R. Swann, III

*Attorney, Agent, or Firm*—Burns, Doane, Swecker & Mathis

[57] ABSTRACT

A switch and alarm system capable of detecting any one or more of the conditions of angular tilt, vibration or sudden movement includes a conically shaped movable contact suspended within an aperture in a fixed contact. The cone forming the movable contact is preferably suspended with its apex down to thereby render it inherently unstable, and hence sensitive to any applied vibrations. The sensitivity of the switch to the conditions to be detected can be adjusted by varying the height of the movable contact relative to the stationary contact to thereby vary the spacing between the two contacts. In addition, the radial position of the cone relative to the aperture in the stationary contact can be adjusted to permit the switch to be used in a variety of applications.

9 Claims, 3 Drawing Figures

SWITCH AND ALARM SYSTEM RESPONSIVE TO SUDDEN MOVEMENT, ANGULAR TILT AND VIBRATION

BACKGROUND OF THE INVENTION

The present invention relates to switches, and more particularly to switches of the type that produce a signal, i.e., closure of contacts, upon detection of any one or more of the conditions of sudden movement, angular tilt, or vibration.

A substantial number of switches capable of sensing one or more of these conditions are presently available on the market. One technique for sensing movement or angular tilt that is commonly employed in switches of this type utilizes a conductive ball or roller disposed on an inclined or curved surface. In a normal position, the ball or roller is spaced from one of the contacts of the switch due to the design of the surface on which it rests. However, when the switch is moved or tilted, the ball rolls along the inclined or curved surface to a point where it electrically bridges the gap between two contacts to close them. In a variation of this technique, a pool of mercury is substituted for the ball or the roller.

In another type of movement sensitive switch, a movable contact, such as a metal rod, is pivotally suspended such that its free end, remote from the pivot point, is disposed proximate, but spaced from, a stationary contact. For example, the stationary contact can be a metal ring that surrounds the free end of the rod. In a switch of this type, the switch contacts are closed when the structure to which the switch is attached is suddenly jerked, wherein the inertia of the movable contact brings it into contact with the fixed contact, or when the switch is tilted to cause the pivot point to rotate relative to the fixed contact, thereby bringing the two contacts into engagement with one another.

For the most part, prior art switches for detecting movement, angular tilt or vibration have been designed with a specific application in mind. Therefore, the switch has a built-in sensitivity to a particular condition, e.g., angular tilt, that is required for the desired application. Attempts to utilize the switch in an application different from that for which it was designed are not usually successful, because the switch is either too sensitive or not sensitive enough for the new application. Adjustment of the sensitivity of the switch is often difficult, if not impossible. For example, in switches of the type utilizing a ball on an inclined or curved surface, the angle of inclination or radius of curvature of the surface, and perhaps the size of the ball or roller, would have to be changed in order to alter the sensitivity of the switch. Likewise, in a switch of the type utilizing a suspended rod surrounded by a stationary metal ring, the radius of curvature of the ring, or the distance between the pivot point and the ring must be changed. Each of these types of changes require substantial alteration to the structure of the switch itself.

One particular field in which it is desirable to provide a motion sensitive switch having easily variable sensitivity is in connection with anti-theft and anti-intrusion alarm devices. For example, if the alarm device is intended to be used on typewriters, the amount of vibration that is imparted to the device during normal typewriter operation will vary in dependence upon the particular type of typewriter and the type of support surface on which it rests. The ability to adjust the sensitivity of the switch provides a significant advantage, since the sensitivity of the alarm device can be set at a level which will enable it to operate effectively at a particular location without being triggered by normal everyday operation.

It is therefore a general object of the present invention to provide a novel switch that is capable of providing an electrical signal in response to detection of angular tilt, movement and vibration.

It is another object of the present invention to provide a novel switch of this type in which the sensitivity of the switch to the conditions to be detected can be easily adjusted without requiring a change in switch structure.

It is a further object of the present invention to provide a novel switch having general applicability to a variety of different types of anti-theft and anti-intrusion alarm devices.

It is yet another object of the present invention to provide a novel motion-sensitive alarm system.

A switch that is responsive to angular tilt, having adjustable sensitivity to the degree of angular tilt required to close the switch contacts, is disclosed in U.S. Pat. No. 3,786,469. The switch disclosed in this patent has a movable contact comprised of a bob that is suspended by a chain within a stationary contact comprised of a conically-shaped cup. The end of the chain remote from the bob is attached to a pivotable support structure which enables the vertical position of the bob within the cup to be adjusted to thereby vary the sensitivity of the switch to angular tilt. The specific purpose for the switch that is disclosed in the patent is to detect wave motion, and therefore the switch is responsive to only relatively large angular variations.

Although the sensitivity of the switch can be adjusted, it is not generally suited for application in a variety of anti-theft devices, due in large part to its relative insensitivity to vibration. This insensitivity is a result of the dampening effect that the chain and the weight of the bob have on vibrations. In other words, only vibrations of a significant magnitude sufficient to tilt the structure on which the switch is mounted would cause the suspended bob to come into contact with the stationary cup. Smaller vibrations would be damped out by the chain and not transmitted to the bob. Furthermore, the inherent electrical resistance of a bead chain does not render it suitable for use as an electrical conductor, and it can result in faulty operation of the circuit in which the switch is incorporated. Therefore, a switch of this type would not be suitable for use in an anti-theft alarm device that is attached to typewriters, for example, wherein it is possible for a thief to vertically lift a typewriter and slowly carry it away without tilting the typewriter or jerking it by an amount sufficient to close the contacts of the switch. However, it is often quite difficult to carry a typewriter away without imparting at least some vibratory movement to it.

It is therefore yet another object of the present invention to provide a novel switch that is responsive to both angular tilt and vibration to close its contacts upon the occurrence of either one of these conditions, to thereby render the switch suitable for use in a wide variety of anti-theft alarm applications.

BRIEF DESCRIPTION OF THE DRAWINGS

The manner in which the present invention achieves the foregoing objects and provides attendant advantages will be appreciated upon a perusal of the following detailed description of a preferred embodiment thereof, when taken in conjunction with the accompanying drawings, in which.

DETAILED DESCRIPTION

In the following detailed description, the preferred embodiment of the present invention is described with reference to its use in an alarm circuit. However, it will be readily apparent to those of ordinary skill in the art that a switch implementing the present invention can be used with equal success in practically any environment in which it is desirable to detect of any one or more of the conditions of angular tilt, movement or vibration.

Figure 1:
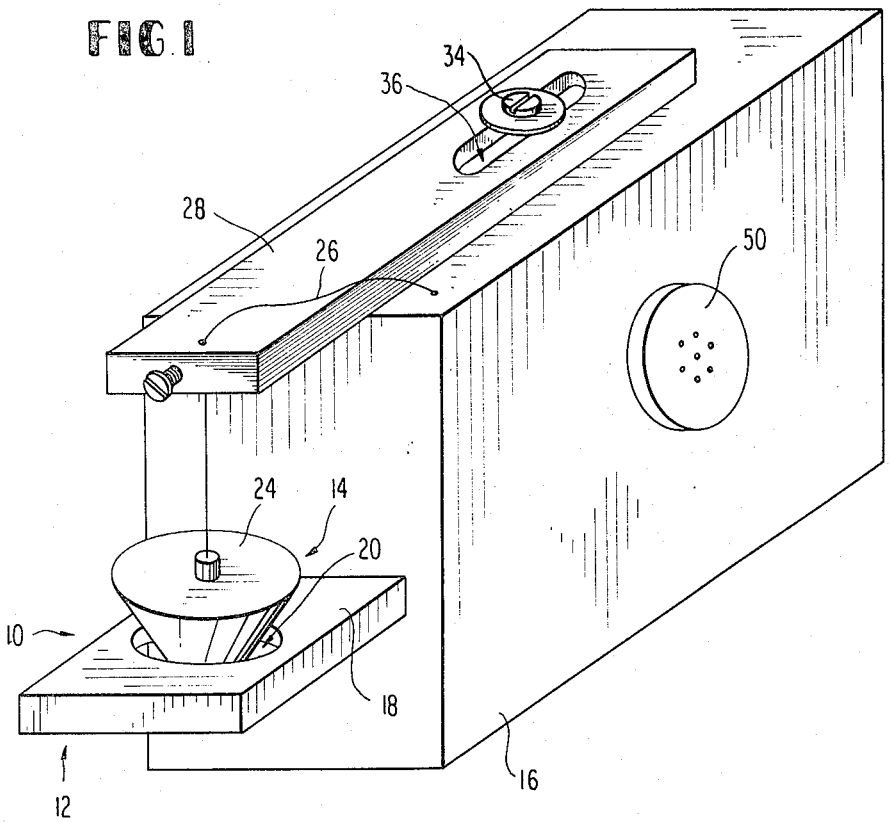
FIG. 1 is a perspective view of the preferred embodiment of a motion sensitive switch implementing the present invention.
Figure 2:
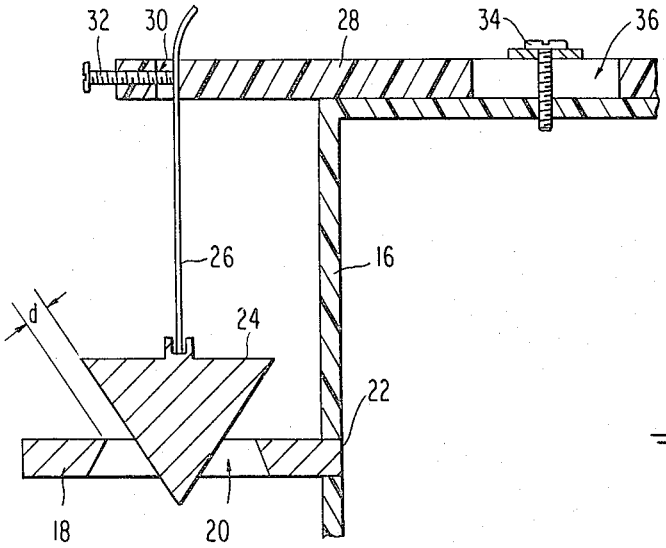
FIG. 2 is a cross-sectional view of a portion of the structure illustrated in FIG. 1.

Referring to FIGS. 1 and 2, a preferred embodiment of a motion sensitive switch implementing the principles of the present invention is illustrated. The switch 10 includes a stationary contact 12 and a movable contact 14. The stationary contact 12 is rigidly attached to a support housing 16, and comprises an electrically conductive plate 18 having an aperture 20 in its center. A suitable electrical lead 22 is attached to the plate 18 for connecting the stationary contact in an electrical circuit, such as that illustrated in FIG. 3.

The movable contact 14 comprises a cone 24 made of a suitable electrically conducting material, or coated to have an electrically conducting surface. The cone 24 is suspended within the aperture 20 of the stationary contact 12 by means of a flexible wire 26. The wire 26 is preferably in electrical contact with the electrically conductive surface of the cone 24, and thereby forms the electrical lead for the movable contact.

The structure for supporting the suspended cone within the aperture of the stationary contact includes a support bar 28 that is preferably made of an insulating material, such as plastic. The bar 28 includes an aperture 30 through which the suspending wire 26 for the movable contact is inserted. One end of an adjusting screw 32 is disposed within the aperture 30 and presses the suspending wire 26 into engagement with the wall of the aperture 30, thereby maintaining the position of the wire relative to the support bar, and hence the height of the cone within the aperture 20, fixed. By unscrewing the adjusting screw 32, the support wire 26 is released and can be adjusted so that the height of the movable contact 14 relative to the stationary contact 12 can be varied. By varying the position of the two contacts relative to one another, the distance d between their electrically conductive surfaces is varied, to thereby vary the sensitivity of the switch. In other words, if the height of the movable contact 14 is increased to thereby increase the distance d between the two contacts, a greater degree of angular tilt of the switch structure, a more sudden jerking of the switch structure, or a greater vibrational force will be required to bring the two contacts into engagement with one another to close the switch. Similarly, a lowering of the movable contact relative to the stationary contact will decrease the space between them and thereby increase the sensitivity of the switch.

As illustrated in FIG. 1, the support housing 16 for the switch structure can comprise a box-like case. In the illustrated embodiment, the support bar 28 is attached to the top wall of the case 16 by means of a second adjusting screw 34. The adjusting screw 34 is disposed in a longitudinal slot 36 in the support bar 28. The attachment of the support bar 28 to the case 16 by means of a single screw 34 enables the bar to be pivoted relative to the case. In addition, the longitudinal slot 36 in the bar permits longitudinal movement of the bar relative to the case. Thus, the movable attachment of the bar to the case provides for another type of adjustment of the switch 10. Specifically, the ability to pivot and longitudinally slide the bar 28 enables the position of the movable contact 14 to be radially adjusted relative to the aperture 20 in the stationary contact 12. This type of adjustment permits the switch to be used in a wide variety of applications. For example, if the switch must be mounted in a location wherein one or more of the side walls of the case 16 are not exactly vertical, so that when the movable contact 14 is suspended the suspending wire 26 is not parallel to the side wall of the case 16, the support bar 28 can be adjusted so that the movable contact 14 will be suspended within the center of the aperture 20 out of contact with the plate 18 in a normal position. Furthermore, the walls forming the aperture 20 in the plate 18 can be beveled, as illustrated in FIG. 2, so as to provide ample free space for suspending the movable contact 14 without having it touch the lower edge of the wall of the aperture when the suspending wire 26 is disposed at an angle relative to the side wall of the case 16.

A further feature of the present invention lies in the particular disposition of the conical member 24 forming the movable contact. As illustrated in FIGS. 1 and 2, the cone 24 is suspended from its base surface so that the apex of the cone points down. When disposed in this configuration, the center of gravity of the cone 24 is nearer to the top surface of the cone rather than its apex, due to the fact that most of the mass of the cone is near the top. Since the center of gravity of the cone is so high, the equilibrium position of the cone is inherently unstable in contrast to a cone that is suspended by its apex so that its center of gravity is relatively low. A cone suspended by its apex, being relatively stable, would respond only to angular tilt of the switch structure. However, by suspending the cone 24 with the apex down, the switch is also capable of detecting vibrations, since the unstable cone would attempt turn over in response to applied vibration. Thus, by arranging the movable contact in the manner illustrated in the Figures, the switch is capable of providing an electrical signal in response either one of the conditions of applied vibration or angular tilt, as well as sudden jerking movement of the switch wherein the inertia of the cone 24 would cause it to move into contact with the stationary contact 18.

The sensitivity of the switch to vibration is dependent upon three factors. As discussed previously, the height of the cone, which determines the distance d between the cone and the stationary contact 12, determines the amount of movement of the cone relative to the stationary contact 12 that is necessary to bring the two into engagement. In addition, the particular shape of the cone, which determines the location of its center of gravity, will play a roll in the degree of inherent unstability of the cone when suspended with its apex down. Finally, the material used for the suspending wire 26 will determine the amount by which vibrations are dampened as they are transmitted to the cone. Specifically, a thin wire would be expected to dampen the vibrations less than a thick wire, and thereby render the switch more sensitive to applied vibrations. Therefore, it will be appreciated that by varying the type and thickness of material used for the suspending wire, the sensitivity of the switch to vibrations can be modified.

Figure 3:
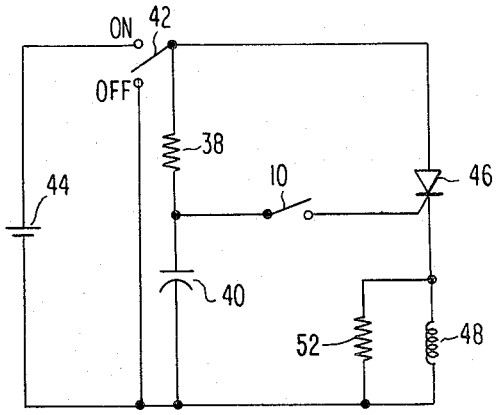
FIG. 3 is a schematic circuit diagram of an alarm circuit incorporating a motion sensitive switch such as that illustrated in FIGS. 1 and 2.

An embodiment of an alarm circuit in which the switch of FIGS. 1 and 2 can be utilized is illustrated in the schematic circuit diagram of FIG. 3. One lead of the switch 10, for example, the lead 26 of the movable contact, is connected to the junction of a series connected resistor 38 and capacitor 40 forming an RC delay circuit. An actuating switch 42 is connected to one end of the resistor 38, and when placed in the ON position, the switch 42 connects the RC delay circuit in parallel with a source of electrical power, such as a battery 44. When placed in the OFF position, the switch 42 connects the two remote ends of the resistor 38 and the capacitor 40 to one another, thereby placing the two elements forming the RC delay circuit in parallel with one another.

An electrically actuated switch, such as an SCR 46, has its gate electrode connected to the other lead of the switch 10. The SCR 46 is connected in series with a suitable indicating mechanism, such as the coil 48 of a buzzer 50. The series connection of the SCR 46 and the coil 48 is in parallel with the RC delay circuit 38, 40. The components of the circuit can be enclosed within the interior of the case 16, for example.

In operation, when the switch 42 is in the OFF position, the capacitor 40 discharges through the resistor 38 and the battery 44 is disconnected from the circuit. When the switch 42 is switched over to the ON position, the capacitor 40 begins to charge through the resistor 38. During the initial charging of the capacitor 40, the voltage across the capacitor is less than the voltage level required to actuate the SCR 46 if the switch 10 is closed. The length of the time period during which the voltage charge on the capacitor remains below the triggering level is determined by the component values of the resistor 38 and the capacitor 40, and the sensitivity of the SCR 46. This initial period is preferably designed so as to provide sufficient time to actuate the alarm system and enable vibrations or movement that can be induced during the initial setting up of the alarm, such as attaching it to a door or placing it on a typewriter, to subside or be completed.

Once the capacitor 40 is charged to the minimum voltage level necessary to trigger the SCR 46, any momentary engagement of the two contacts of the motion sensitive switch 10, for example in the order of one microsecond, will trigger the SCR 46 into conduction, thereby providing current to the coil 48 to actuate the buzzer 50. A resistor 52 can be placed in parallel with the coil 48 in order to provide a current path that maintains the SCR 46 conducting if current flow through the coil 48 is interrupted during operation of the buzzer, such as by opening of the buzzer leads.

By subsequently switching the actuating switch 42 over to the OFF position, the battery 44 will again be disconnected from the circuit, thereby interrupting the flow of current to the buzzer 48 and rendering the SCR 46 non-conducting, while at the same time discharging the capacitor 40 through the resistor 38.

The particular switch and alarm construction disclosed herein can be easily incorporated in a small package that lends itself readily to a wide variety of applications. For example, the original reduction to practice of the invention measured $5 \times 3 \times 1\frac{1}{2}$ inches, and it is expected that a more compact structure can be easily attained with appropriate tooling.

As discussed previously, the switch and alarm system of the present invention are particularly suited for use in anti-theft and anti-intrusion alarm devices. Details of a particular alarm device adapted to accommodate the present invention can be obtained from U.S. patent application Ser. No. 260,195, filed on May 4, 1981, by S. Bitko.

The present invention may be embodied in other specific forms without departing from the spirit or essential characteristics thereof. The presently disclosed embodiment is therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. A switch having variable sensitivity to tilt and movement, comprising:

a fixed contact comprised of an apertured plate;

a conically shaped movable contact suspended within the aperture of said fixed contact and normally out of contact with said fixed contact; and means for adjusting the height of said movable contact relative to said fixed contact and for adjusting the radial position of said movable contact relative to said fixed contact to thereby vary the spacing between said fixed and movable contacts and vary the sensitivity of said switch to tilt or movement.

2. The switch of claim 1 wherein said movable contact is suspended with its apex down.

3. The switch of claim 1 wherein said movable contact is suspended within the aperture of said fixed contact by means of a flexible wire.

4. An alarm system for indicating angular tilt or movement, comprising:

a source of electrical power;

a delay circuit comprised of a series connected resistor and capacitor;

an actuating switch for selectively connecting said delay circuit to said source of electrical power and connecting said resistor and said capacitor in parallel with one another;

means for generating an indicating signal;

a movement responsive switch for applying power to said indicating means upon detection of movement after a predetermined time period from actuation of the alarm system as determined by said delay circuit has lapsed, said movement responsive switch including a fixed contact comprised of an apertured plate and a conically shaped movable contact suspended within the aperture of said fixed contact, one of said contacts being connected to the junction of said resistor and said capacitor and the other of said contacts being operatively connected to apply power to said indicating means, and means for adjusting the height of said movable contact relative to said fixed contact and for adjusting the radial position of said movable contact relative to said fixed contact.

5. The alarm system of claim 4, further including an electrically actuated switch connected in series with said indicating means, wherein the series connection of said electrically actuated switch and said indicating means is connected in parallel with said delay circuit and the other contact of said movement responsive switch is connected to a triggering electrode of said electrically actuated switch.

6. The alarm system of claim 5 wherein said electrically actuated switch is an SCR.

7. The alarm system of claim 4 wherein said adjusting means comprises a support bar from which said movable contact is suspended, said support bar being pivotally and longitudinally movable relative to said fixed contact.

8. the alarm system of claim 4 wherein said movable contact is suspended with its apex down.

9. The alarm system of claim 4 wherein said movable contact is suspended within the aperture of said fixed contact by means of a flexible wire.

* * * * *